United States Patent [19]

Simonson

[11] 3,943,054

[45] Mar. 9, 1976

[54] SEGMENTED SCREEN BODY

[75] Inventor: Gordon L. Simonson, Frederic, Wis.

[73] Assignee: Durex Products, Inc., Luck, Wis.

[22] Filed: Dec. 19, 1974

[21] Appl. No.: 534,585

[52] U.S. Cl. ..... 209/392; 209/393; 209/397

[51] Int. Cl.[2] ..... B07B 1/46

[58] Field of Search ..... 209/392–395, 209/397–403

[56] References Cited

UNITED STATES PATENTS

| | | | |
|---|---|---|---|
| 444,252 | 1/1891 | Palm | 209/395 |
| 647,399 | 4/1900 | Geske et al. | 209/395 |
| 2,706,048 | 4/1955 | Riedel | 209/395 |
| 2,883,052 | 4/1959 | Shovlain | 209/394 |
| 3,334,744 | 8/1967 | James et al. | 209/394 |
| 3,833,120 | 9/1974 | Ogata | 209/399 |

FOREIGN PATENTS OR APPLICATIONS

| | | | |
|---|---|---|---|
| 1,197,310 | 7/1965 | Germany | 209/400 |
| 475,428 | 11/1937 | United Kingdom | 209/397 |
| 2,130,177 | 12/1971 | Germany | 209/395 |
| 60,136 | 5/1947 | Netherlands | 209/397 |
| 829,403 | 12/1951 | Germany | 209/395 |

*Primary Examiner*—Frank W. Lutter
*Assistant Examiner*—Ralph J. Hill
*Attorney, Agent, or Firm*—Williamson, Bains & Moore

[57] ABSTRACT

A segmented screen body or bottom for classification, screening and washing of fragmented hard stocks employs a multiplicity of segmented elements constructed of elastomer or rubber material which, when abutted and supported in predetermined relations, define sieve apertures of a predetermined size and extending, if desired, in staggered longitudinal rows. The structure further requires a multiplicity of parallel transverse metal wires or equivalent elements which are embedded and extend through appropriate apertured portions of the elastic components. In the preferred form the essential elements include T-shaped and L-shaped elements, all of which may be obtained from identical integral moldings of T-shape and many of which are cut along transverse lines at the T-top to provide from the same moldings complementary L-shaped elements.

6 Claims, 10 Drawing Figures

FIG. 6
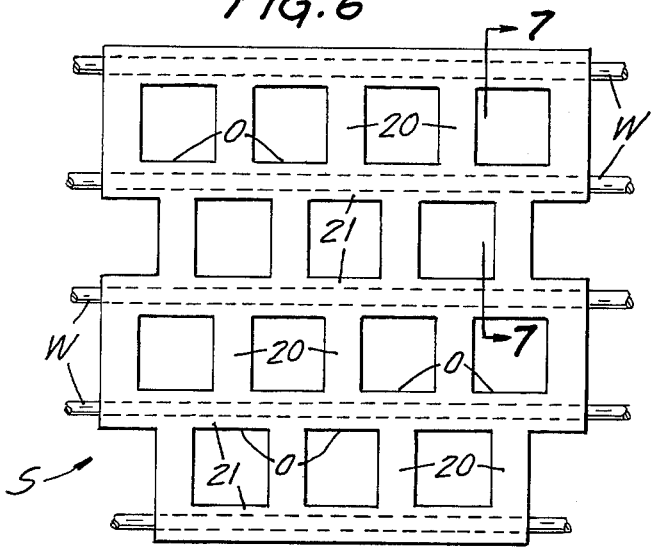
FIG. 7
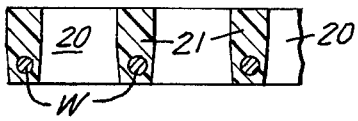
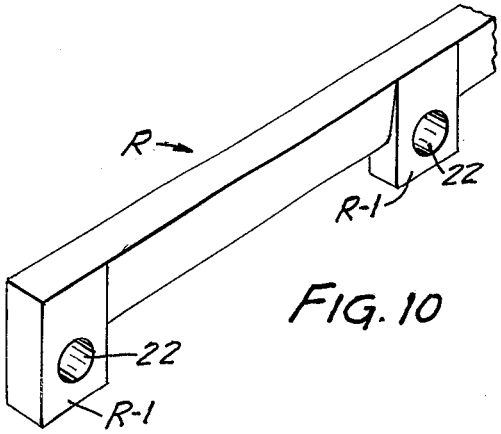
FIG. 10
FIG. 8
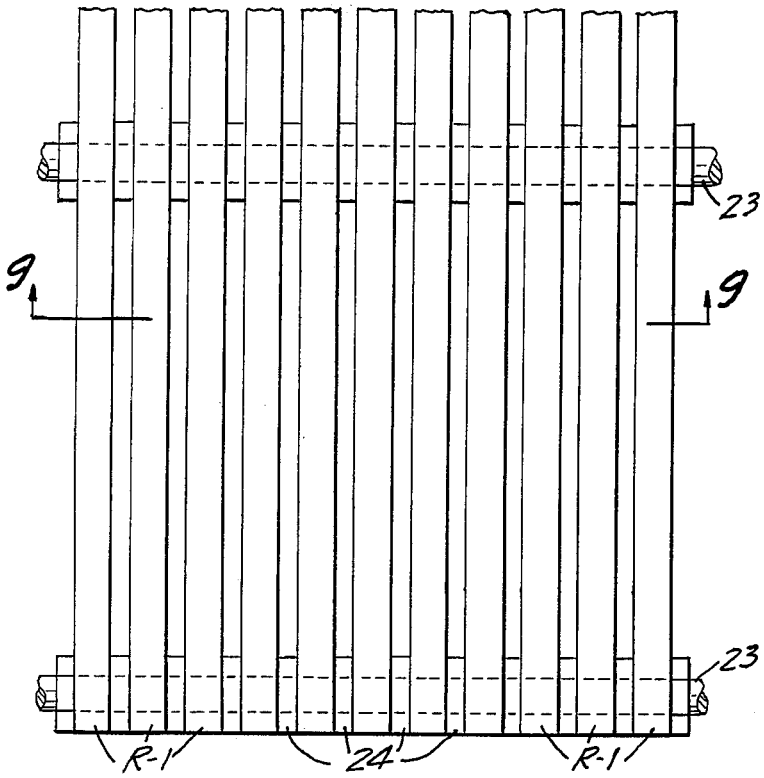
FIG. 9
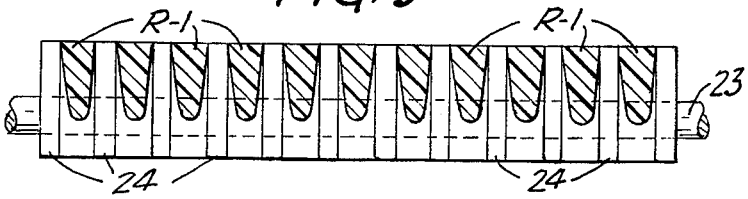

SEGMENTED SCREEN BODY

BACKGROUND OF INVENTION

For many decades separation, classification, cleaning and dewatering of fragmented stocks of hard materiial such as stone, aggregate, coal, sand and the like have been accomplished by shaker screen boxes having screen bodies made up of either coarse-woven steel or other metal netting or of relatively thin sheet metal material provided with sieve openings arranged in predetermined sequence or manner. The abrasion and wear from hard material striking the charging surfaces of such sieves, as well as the tumbling and flow of hard material on such surfaces, has caused rapid deterioration of the metal material.

Further corrosion and deformation of the material has shortened the life of such screens. The din and noise from the charging of such screens and the bouncing and tumbling of hard material has been a source of noise pollution.

In the last fifteen years several efforts have been made to lengthen life of such metal screens by applying coatings of somewhat flexible elastic or elastomer material and in several instances whole screen bodies or sectional screen bodies, each providing a multiplicity of sizing apertures, have been employed. Some of these have been supported and reinforced by an underlying mesh of steel, wires or the equivalent. Complicated molding processes have been required for such prior art shaker screens and since a manufacturer is required to make and have available sieves or screens having mesh sizes, sometimes square, sometimes round, sometimes elongate, in as many as a hundred sizes, the original or investment costs of such molds and processing is extremely high. Some prior structures have employed laminations of elastomer sheets vulcanized to metal sheets and some have employed two or more plies of elastomer sheets of large size properly punched or apertured for the sizing required.

It is an object of my invention to provide a very simple segmented screening body adapted for shaker or vibratory box use which, for each mesh or aperture size of classifying desired, requires essentially, in the preferred form, only one precision mold with facilities for quickly cutting portions from the molding to make complementary segments together with facilities for drilling or boring transverse bores through predetermined portions of the components or segments. For mounting and reinforcing said segments or components a plurality of transverse metal wires or equivalent filaments are employed extending through the said bores and beyond the longitudinal edges of the screen for formation of hooks or attachment means to the shaker box or frame. The employment of such complementary-acting relatively thick segments and components provide charging surfaces for the sieve which very substantially reduces the wear; provides a more uniform and gentle bouncing and tumbling of the particulate hard material along the charging surface; avoids corrosion of materials used, eliminates deformation of the charging surface and very substantially limits noise pollution in operation.

DETAILED DESCRIPTION OF A PREFERRED EMBODIMENT

From the following description made in connection with the accompanying drawings, the construction, composition, functions and advantages of our invention will be clear. In the drawings, FIG. 1 is a diagrammatic cross section showing an embodiment of the invention applied to a conventional shaker box and provided with tensioning means for the sieve body on a reduced scale;

FIG. 6 is a plan view of a second form of the invention;

FIG. 7 is a cross section on the line 7—7 of FIG. 6;

FIG. 8 is a plan view of a third form of the invention;

FIG. 9 is a cross section taken on the line 9—9 of FIG. 8; and

FIG. 10 is a fragmentary perspective view of the essential elements.

Figure 5:
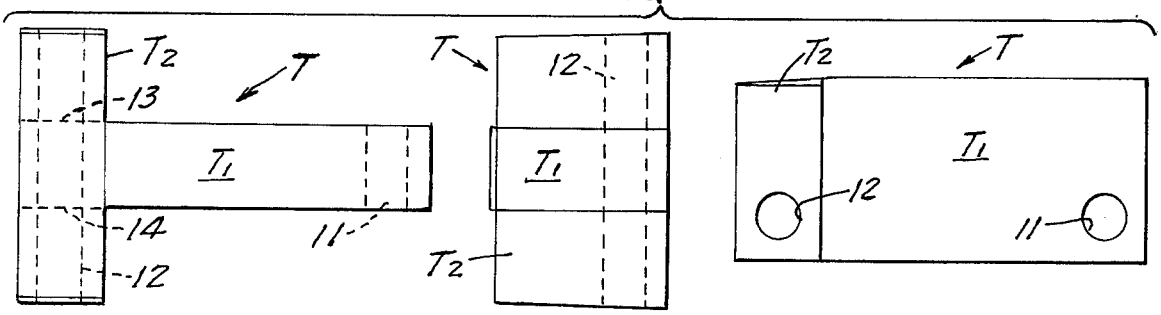
FIG. 5 is a bracketed view on a somewhat larger scale than FIG. 2 showing in top plan view, side elevation and end elevation an integral elastomer member which alone, in combination with other components severed therefrom, constitutes all of the essential elements (with exception of edge finishing) of my preferred screen body.

In the form of the invention shown in FIGS. 1 to 5 inclusive, an elastomer member, molded or otherwise formed from materials such as (but not limited to) styro-butadiene, carboxylated Nitriles, poly urethanes, natural rubber and synthetic rubber, is essential. This member, as shown in detail in bracketed FIG. 5, is identified as an entirety by the letter T, and as shown is relatively thick compared to the general width thereof and has a T-stem straight portion T-1 preferably tapering from the top or charging surface and provided near the lower end of the stem with a transverse rod or wire-receiving bore 11. The top of the T T-2 is of similar thickness to the stem portion T-1 and, as shown, is provided with a bore 12 extending parallel with the bore 11 and from end-to-end of the T top portion T-2. Preferably the end portions of the T top T-2 are slightly tapered from their rear surfaces to their upper or charging surfaces.

Figure 2:
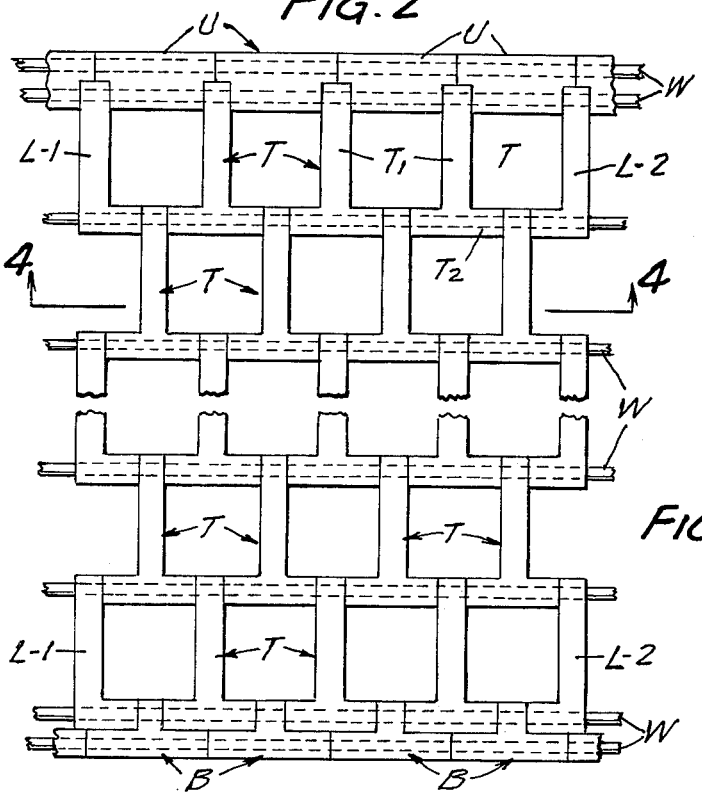
FIG. 2 is a fragmentary top plan view on a larger scale showing a portion of a classifying screen for aggregate or other fragmented hard materials; the view is foreshortened but shows a multiplicity of the sieve-aperture-forming units and also shows the finishing edges for the upper and lower edges of the overall sieve or screen.
Figure 3:
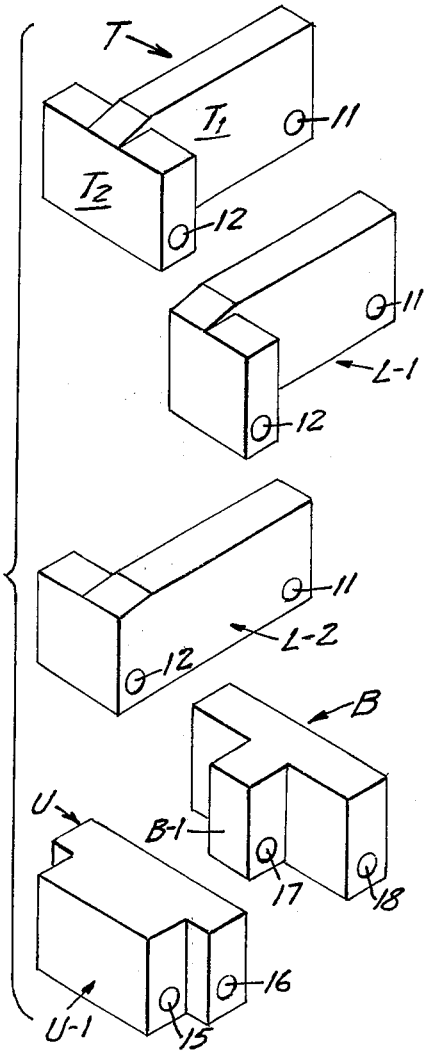
FIG. 3 is a bracketed view showing in perspective all of the requisite elastomer components for a finished screen.
Figure 4:
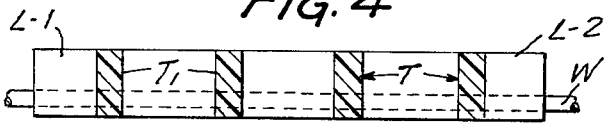
FIG. 4 is a cross section taken on the lines 4—4 of FIG. 2 looking in the direction of the arrows.

Multiplicities of the entire T members T arranged and secured together by stout wires W, as shown in FIG. 2, constitute in combination by far the greater areas of my improved screen body. However, for defining and closing the longitudinal or side edges of the screen, additional L-shaped elements are employed complementary in shape to the overall T members. Both lefthand and righthand L-members are needed and these may be easily and conveniently cut from the common T members T along the closely dotted lines 13 and 14 shown in the bracketed FIG. 5. The lefthand, preferably severed L-member L-1 shown in bracketed FIG. 3, is cut along the line 13 while the righthand L-member L-2 is cut along the dotted line 14 of FIG. 5.

It will be seen that with the complementary interarrangement of the component members T, L-1 and L-2 as shown in FIG. 2, the bores 11 and 12 formed in the original T-members are precisely aligned with the corresponding bores of the severed components L-1 and L-2. Preferably in core-molding or otherwise producing such bores, the diameters thereof are purposely very slightly smaller than the normal diameters of the wires W employed for reinforcing and interconnecting the components. To facilitate passage of the respective wires W through the aligned bores 11 and 12 of the components, glycerine or other lubricant is applied and preferably suitable jigs are employed for aligning the successive transverse rows of components.

After insertion of the connecting and reinforcing wires W (leaving excess of wire beyond the side edges of the screen for formation of retaining hooks), anchoring elements such as Tinnerman washers may be employed against the outermost elastomer elements on the longitudinal edges of the overall screen or sieve. They are not necessary for most sieve sizes.

Although not necessary for successful operation of my screen bodies, I prefer to provide transversely disposed "finishing" blocks for reinforcing the uppermost and lowermost transverse edges of the screen body. Thus (see FIG. 3) elastomer blocks U are provided, complemental in shape to the aligned T-stem ends of the uppermost row of units and having rectangular enlargements U-1 for interfitting said T-stems. Said blocks U are each provided with bores 15 and 16 for receiving wires W. Bores 15 are for alignment with the stem bores 11 of the respective T units. An additional reinforcing wire passes through the bores 16 of said blocks U. At the lowermost edge of the screen body a plurality of special elastomer blocks B is employed, complemental in shape to the transversely disposed, spaced T-tops and marginal L's of the components. Blocks B have medial rectangular tongues B-1 which interfit appropriately the spaces between the lower transverse row of T and L elements. They are provided with bores 17 and 18 near their under surfaces for alignment to receive two supporting wires W.

Figure 1:
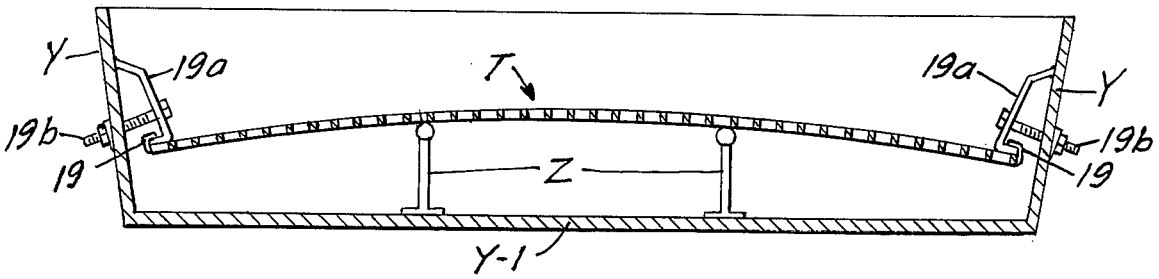

As shown in FIG. 1, the screen body may be operatively secured in a conventional shaker box by hooks 19 formed on the several transverse reinforcing wires W at the projecting ends thereof. The hooks engage loops at the lower ends of tensioning arms 19*a*, said arms pivoted at their upper ends to the sides Y of the box may be forcibly swung outwardly by nutted tensioning bolts 19*b*.

Longitudinal "bumper" bars Z secured in parallel widely spaced relation may also be used to further elevate and tension the screen. As shown, bars Z are affixed to the bottom Y-1 of the shaker box.

I prefer to mold or by plastic injection form the T-units with coring of the wire receiving bores 11 and 12 therein. This greatly reduces investment costs on the part of the manufacturer and enables units to be formed which are of substantial thickness relative to the general width of the elements, thus affording thicker wear surfaces. However, particularly in smaller sieve mesh sizes, it will be understood that the T-units and finishing blocks may be die cut from a suitable thick sheet of the proper elastomer material.

While in the drawings the proportions (of the T-stem and T-top) are such that in complement square sieve-openings are produced, by varying the proportions various elongate or slit-openings may be achieved for screens designed for classifying slivery or elongate particle stock. Obviously by dimensionally enlarging or decreasing the dimensions of T-units, sieve apertures varying widely in area may be provided.

In the operation of my preferred segmented structure, flexibility of the overall screen body along many transverse lines (defined by the wires W) is obtained. The result is that in the charge-impact of aggregate and the like even from high elevations, deformation and wear is greatly reduced. Hinge or wearing action between the transversely arranged units takes place to a limited extent to enhance the resultant tumbling and bouncing actions of the hard fragmented material. Additional new and improved results will be reviewed at the end of this specification after description of additional embodiments of my invention.

It will be seen that the inherent structure and complemental mounting of the preferred segmented embodiment of my invention provides uniformly staggered longitudinal rows of sieve apertures with minimal requirement of intervening solid elastomer material.

A SECOND EMBODIMENT

In FIGS. 6 and 7 of the drawings another embodiment of my invention is illustrated, particularly adapted for screens of relatively small sieve-aperture sizes.

Here a waffle-like screen body section S is produced, preferably by molding, having the staggered rectangular longitudinal rows of sieve openings O. The overall configuration is almost identical with that of the segmented hinged unit embodiment illustrated in FIGS. 1 to 5 inclusive.

The solid portions of the waffle-like section comprise longitudinal bar portions 20 and transverse bar portions 21 and are slightly tapered from their upper charging surfaces to their under surfaces. This facilitates classifying of "through" size particles.

Section S is preferably integrally molded or cast from a desirable elastomer material with the requisite number of transverse supporting wire-receiving bores cored or otherwise formed therein. Wires W may be embedded in the molds if two-part molds are used and in such instance will have connection elements at their extremities for juncture with abutting screen sections of similar structure.

In fabricating a full screen body a plurality of the sections S are vulcanized or otherwise secured and integrated along abutting edges.

In this form it again will be seen that flexibility and some hinging of elastomer material along the many wire reinforcing lines occurs during the charging, vibration and operation of this form of my invention.

A THIRD EMBODIMENT OF THE INVENTION

In FIGS. 8 to 10 inclusive, of the drawings I illustrate a third embodiment of the invention which is particularly adapted for sifting, classifying and watering operations on certain types of fragmented solid materials. In this form a lattice construction is made up of a plurality of elongate parallel bars or rails R constructed of the desirable elastomer materials and having transverse, substantially vertical, flat enlargements, constituting transverse bar extensions R-1 longitudinally spaced throughout their overall length. The bars R, as shown in the drawings, are cross sectionally tapered from their upper, charge-receiving surfaces to their lower edges.

The T-ears, R-1 are transversely bored through the ears and rail body R to receive transverse, relatively heavy rod wires 23.

Rectangular, apertured spacer blocks 24 are interspersed between pairs of the elongate bars or rails R for completing with rods 23 and the ears R-1, the overall lattice work structure of this screen.

The projecting end of the wire rods 23 at each of the longitudinal sides of the screen body are suitably secured to the sides Y of the shaker box.

It will be understood that the upper edges of the bars or rails R lie in substantially a common plane and that the shaker box or longitudinal rails are inclined to the horizontal at a somewhat greater angle usually than the positioning of the charge-receiving surface of the screen body previously described in this specification.

It will be seen that the three embodiments of the invention have certain closely combinative common features such as the formation of a lattice construction, principally composed of an elastomer material; each form having interconnected, parallel longitudinal bars of elastomer extending in the flow direction of the material to be sifted and each having transverse bar portions which extend perpendicularly to the longitudinal bars. All of the embodiments, in combination, require a series or plurality of transverse wires or rods, embedded in preferably the lower cross-sectional portion of the interconnected elements. No supporting or reinforcing wires are employed extending longitudinally of the screen body. The transverse embedded wires constitute transverse hinge pintles for permitting flexing and slight swinging of transverse zones of the screen which is highly desirable for cushioning impact of the charged, heavier fragmental material to be classified or sifted.

The second embodiment of the invention has more in common with the preferred embodiment in that the staggered relationship of requisite components or elements is employed in both the first and second embodiment, achieving optimum interconnection of transverse and longitudinal bar elements with minimal widths of such elements, and thereby furnishing most efficient staggered arrangement of the sieve apertures for classifying, sifting, watering or de-watering hard particle materials.

The term "wires" is employed in the claims to designate broadly strong filament elements having greater or less flexibility and including metal rods.

It will of course be understood that a relatively wide choice of elastomer materials may be employed, including those designated herein, polyurethanes, natural and synthetic rubber and many polymers.

The new and improved results attained by my invention may be briefly pointed out as follows:

1. Wear deformation and breakage of my novel screen bodies is very substantially reduced as contrasted with all the conventional metal type netting or screen sieve construction and is appreciably reduced in contrast to any elastomer-coated or elastomer-ply screens known to applicant for use with vibratory sieve boxes.

2. Since my reinforcing and hinge wires and rods are made from non-corrosive metals or other material, no damage through corrosion, rusting or chemical deterioration will be present with our structures.

3. The hinge-like embedding of the plurality of reinforcing along transverse parallel lines, gives flexibility, live action (by transverse zones or discrete elements), increasing wear life of the charging surfaces.

4. The discrete formation of sections and units permits very economical production by casting or molding processes, as constrasted with production costs of all other prior art structures known to applicants.

5. Noise as a pollutant is greatly minimized.

6. Capital and installation costs for production of a great number of different size screen bodies is substantially reduced.

What is claimed is:

1. A segmented, elastic screen body having in combination:

a muliplicity of discrete, complemental, elastomer units, having stem-bar portions extending in the direction of flow of the fragmented material to be sifted and having also terminal, integral transverse-bar portions extending perpendicularly to one end of each stem-bar portion, said transverse-bar portions having wire-embedding bores extending longitudinally therethrough, said stem-bar portions having transverse wire-embedding bores through the second end thereof, said units being arranged and disposed in alternately, longitudinally staggered relation with bores of said transverse-bar portions being aligned transversely of said body with the transverse bores of said adjacent stem-bar portions, and a plurality of reinforcing and interconnecting wires extending transversely in spaced relation across said body and each passing through an aligned series of bores of said units.

2. The structure and combination set forth in claim 1 wherein all of said elastomer units, with the exception of those defining the longitudinal edges of said body are of T-shape to provide said stem-bar portions and said transverse-bar portions, said T-shaped units being arranged and interconnected in alternate, longitudinally staggered relation with the transverse-bars of the T disposed below and interconnected with said bore-provided ends of the stem-bar portions in complementary manner to produce and define longitudinally staggered rows of rectangular screening apertures.

3. The structure set forth in claim 2 wherein the units defining the longitudinal edges of said sifting body constitute elastomer L-shaped bars with wire-receiving bores formed in the base portion of the L.

4. A segmented screen body for classifying and screening fragmented hard-stock materials having in combination, a multiplicity of individual, T-shaped, complemental, aperture-defining units constructed, at least mainly, of elastomer material, said units each having a stem-bar portion extending in the direction of flow of the material to be screened and having a transverse T-head portion connected with one end of said stem-bar portion and having a longitudinal support-wire-receiving bore therethrough, said stem portion having a transverse wire-receiving bore through its other end, said units being arranged and positioned in alternately staggered rows, with the bores of said T-head portions being aligned transversely of the screen body with the transverse bores of the adjacent stem-bar portions, and a plurality of supporting, reinforcing and interconnecting wires fixed and extending in spaced relation transversely across said body and each passing through an aligned series of bores of said units.

5. The structure and combination set forth in claim 4 further characterized by:

said units being integrally formed from elastomer material and the thickness of said units being at least equal to the average width of said unit portions.

6. The structure and combination set forth in claim 4 further characterized by:

said wires constituting tensioned flexible elements, and the passage of said wires through said aligned bores of said units providing for independent hinge action of all of said units on said transverse spaced wires.

* * * * *